United States Patent [19]

Jones

[11] 4,045,924

[45] Sept. 6, 1977

[54] FURNACE ROOF CONSTRUCTION

[75] Inventor: Allen Jacob Jones, Grants Pass, Oreg.

[73] Assignee: S. J. Agnew, Tenino, Wash.

[21] Appl. No.: 640,965

[22] Filed: Dec. 15, 1975

[51] Int. Cl.[2] ..... E04C 3/04; E04B 7/00

[52] U.S. Cl. ..... 52/125; 52/262; 52/486; 110/1 L

[58] Field of Search ..... 110/99 R, 1 R, 1 L; 52/122, 125, 262, 486, 66, 83

[56] References Cited

U.S. PATENT DOCUMENTS

| | | | |
|---|---|---|---|
| 1,461,566 | 7/1923 | Wadleigh | 110/99 R |
| 2,120,861 | 6/1938 | Hastings | 52/262 |
| 2,144,598 | 1/1939 | Brinckerhoff et al. | 110/99 R |
| 2,549,742 | 4/1951 | Yoxall | 110/99 R |
| 3,340,832 | 9/1967 | Grigsby | 110/99 R |
| 3,375,795 | 4/1968 | Merkle, Jr. | 52/122 X |
| 3,670,469 | 6/1972 | Jones | 52/486 X |
| 3,823,523 | 7/1974 | Wells | 52/262 X |

*Primary Examiner*—Leslie Braun

*Attorney, Agent, or Firm*—Kolisch, Hartwell, Dickinson & Stuart

[57] ABSTRACT

A roof assemblage for use in a furnace includes a refractory panel dimensioned to span refractory furnace walls and a wall bearing roof truss from which the refractory roof panel is suspended. The refractory roof panel is suspended by means of hangers which are connected to a bottom chord of the truss and to suspension bars which extend transversely of the roof panel. The truss is arranged intermediate of the width of the refractory roof panel and the bottom chord is situated on bearing anchors which connect the bottom chord at opposite ends thereof to the top of the refractory wall panels. Lifting hooks are provided on the top chord of the truss so that the truss-panel roof assemblage may be lifted as a unit onto and from the furnace walls.

5 Claims, 4 Drawing Figures

FURNACE ROOF CONSTRUCTION

BACKGROUND OF THE INVENTION

A. Field of the Invention

The present invention relates to a furnace construction, and more particularly to a roof unit for placement on top of refractory furnace walls. Specifically, the present invention pertains to a novel truss-panel roof assemblage formed as a unit which may be readily situated on or removed from a supported position on top of refractory wall panels in a furnace.

In furnace constructions it is often desirable to provide upright refractory panel walls which are spaced rather widely apart. Consequently, a refractory roof stucture which spans the distance between the walls without the need for interior upright supports is preferable. Refractory walls and roof panels may include a rectangular iron frame over which an expanse of expanded metal grate has been secured. Attached to such a grate and distributed over a major portion thereof are anchors. A thick layer of cementitious refractory material is formed over the grate and around the anchors. While such a construction provides for an efficient insulative wall or roof panel, it is not satisfactory from a structural standpoint to span relatively long distances. Specifically, such a panel has little resistance to bending moments over large spans and hence additional structural support is required to adequately maintain a refractory roof panel across refractory wall panels.

Additionally, if substantial temperatures are created within a furnace, refractory wall panels will tend to swell and distort which can result in damage to a refractory roof panel structure. If the refractory roof panel is supported, i.e., as by being suspended from a truss or the like, additional resistance to bending moments will be imparted to the roof panel. Furthermore, it is desirable to have a roof panel structure which can be readily lifted onto and from refractory wall panels if it is desired to replace a damaged roof panel or if it is desired to enlarge, tear down, etc. a furnace construction.

B. Description of the Prior Art

Furnace constructions utilizing refractory wall and roof panels are well known in the art, and several proposals have been set forth directed to strengthening a refractory roof panel structure. One example is described in U.S. Pat. No. 3,670,469 wherein a furnace construction utilizes walls which hang on an exterior steel supporting frame. The wall panels are precast and hang from their upper ends from steel I-beam columns which are in turn secured to a concrete foundation. The roof of the furnace comprises apertured refractory blocks which are hung on horizontal rods, the rods being suspended by vertical hanger rods from the lower flanges of an upper I-beam. It is apparent that the furnace structure of this patent requires additional outer I-beam steel framework for providing structural integrity to the wall panels and roof panels.

Another example of refractory blocks forming a roof of a furnace is disclosed in U.S. Pat. No. 1,339,615. Here, a flat arch of refractory material is extending between and supported on side walls of a furnace. Tie rods extend through openings in the arch and serve to provide resistance to bending. In order to accommodate the tie rod, the arch must be constructed of arch-tiles having openings through which the tie rods extend.

A suspended arch for furnaces is described in U.S. Pat. No. 1,921,107. This patent sets forth a furnace construction in which a plurality of tiles are suspended by means of a plurality of suspension bars which have their opposite ends placed on top of side walls of refractory brick material. Such a construction contemplates that each tile be configured with an upsidedown T-slot for enabling the tiles to be slidably disposed upon T-shaped hangers.

A last prior art patent to be considered is U.S. Pat. No. 1,751,675 which describes a removable furnace roof in which units made up of refractory tile are suspended from cross beams so as to be freely adjustable relative to each other under expansion and contraction in any horizontal direction. The cross beams are seated at their opposite ends upon brick-like elements 11 which in turn are placed upon the top of upright vertical walls of a furnace. This patent apparently has as its main object the adjustability relative to each other of refractory roof elements or tiles.

SUMMARY OF THE INVENTION

The present invention is generally directed to the object of providing a truss-panel roof assemblage for a furnace which may be used to span relatively long distances between vertical furnace walls and which may also be readily removed from or placed onto top portions of the walls.

Accordingly, the present invention comtemplates a refractory roof panel structure which is suspended or hung beneath a truss. The truss has top and bottom chords and hangers depend from the bottom chords to tie into suspension bars which are transversely arranged on an outer face of the refractory roof panel. The suspension bars are connected to roof panel frame members.

Another object of the present invention is to provide a truss panel roof assemblage which may be lifted as a unit upright from and onto vertical furnace walls.

A further object of the present invention, in one embodiment, is to provide a refractory roof panel or panels which are suspended from a roof truss by means of hangers depending from the truss's bottom chord which connect onto roof panel transversely extending suspension bars. Here, loads applied to the roof truss bottom chord are transferred through end upright truss members down through removable bearing anchors disposed at either end of the truss which connect the truss to the upright bearing wall panels.

Yet another object of the present invention, in a second embodiment, is to provide a truss panel roof assemblage in which a refractory roof panel has end portions seatable upon the top of upright furnace walls. A roof truss is disposed above the roof panel and is connected to panel frame members. The roof truss provides support for the roof panel which is suspended from the bottom chord of the truss intermediate the upright wall panels. Loads applied to the truss are transferred through upright end members of the truss to the upright wall panels through the end sections of the roof panel which is supported upon the upright wall panels.

Still another object of the present invention is to provide a furnace construction in which a truss-panel roof assemblage is combined with upright refractory wall panels in which the wall panels are kept from substantial warping or misalignment by means of retaining bars or outer wall braces to maintain alignment between adjacent wall panels.

With the foregoing arrangement, and as will be more fully described hereinafter, it is apparent that the present invention provides a novel truss-panel roof assemblage which may be lifted, as a unit, onto or from the top of upright vertical refractory wall panels of a furnace so that a refractory roof panel may be supportively disposed between the wall panels for considerable spans.

Additional objects of the present invention reside in the specific construction of the exemplary assemblage hereinafter particularly described in the specification and shown in the several drawings.

BRIEF DESCRIPTION OF THE DRAWINGS

Novel features of the truss-roof panel assemblage in accordance with the present invention for use in a furnace construction will be more readily understood from a consideration of the following description taken together with the accompanying drawings, in which a preferred embodiment is illustrated with the various parts thereof identified by suitable reference characters in each of the views, and in which.

DETAILED DESCRIPTION OF THE INVENTION

Figure 1:
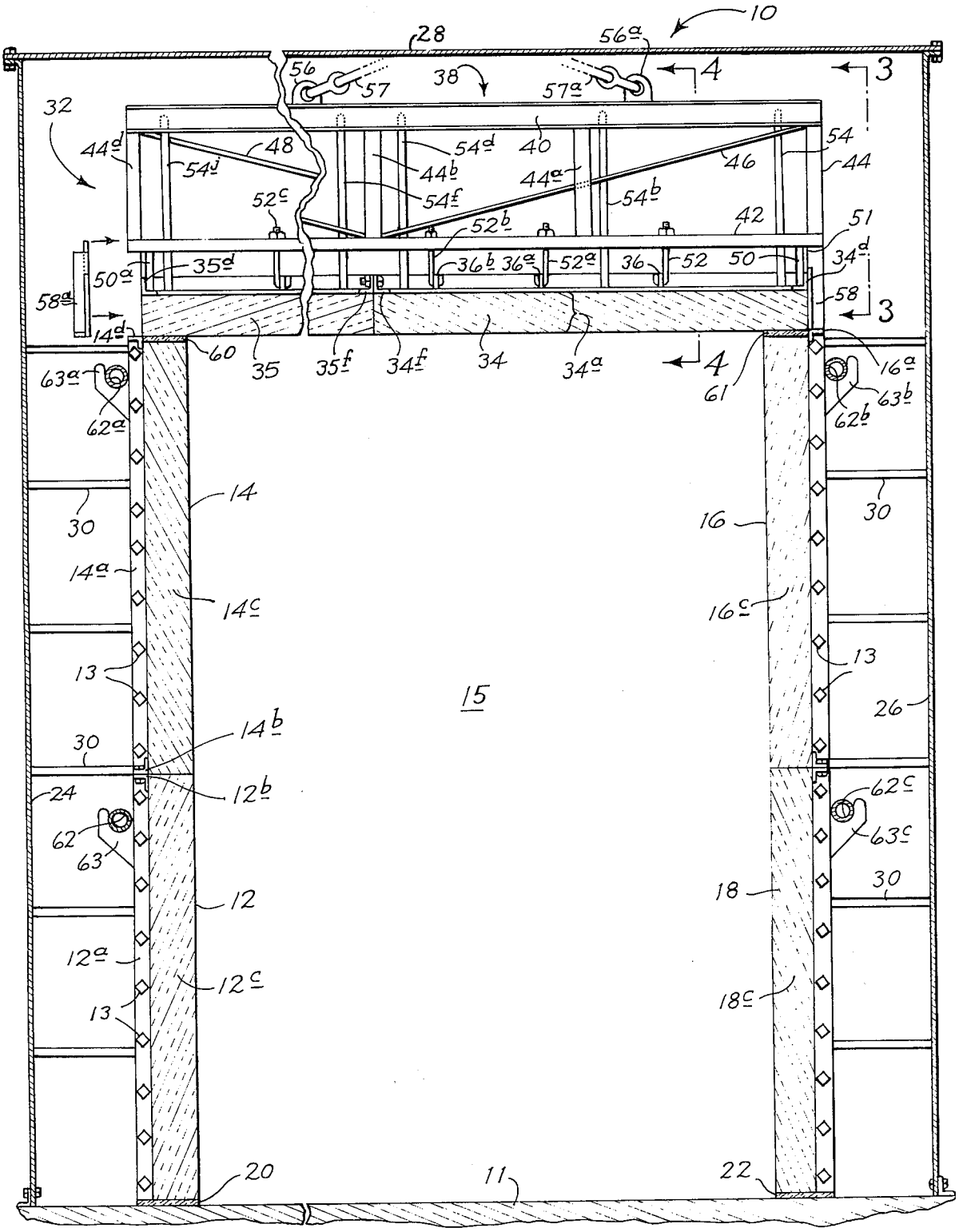
FIG. 1 is a cross-sectional view taken through a furnace having refractory panel walls and illustrates the placement of the truss-panel roof assemblage according to the principles of the present invention.

Turning now to the drawings, and referring initially to FIG. 1, a portion of a furnace utilizing a roof assemblage of the present invention is generally indicated in cross section at 10. Furnace 10 includes upright refractory wall panels 12, 14, 16 and 18. Each of the refractory wall panels has an outer substantially rectangular angle iron frame. Frame members such as indicated at 12*a* and 14*a* are connected to adjacent wall panel frames by means of frame connecting bolts 13. Connected transverse frame members such as 12*b* and 14*b* enable wall panels 12 and 14 to be disposed one on top of another. Likewise wall panels 16 and 18 are connected to each other. An expanse of expanded metal grate has been secured to the frame members. Attached to the grate and distributed over a major portion thereof are anchors (not shown) to which the layer of cementitious refractory material 12*c*, 14*c*, 16*c*, 18*c* is formed. Such a construction is known in furnace organizations.

Insulative pads 20, 22 are disposed between floor 11 and refractory wall panels 12 and 18, respectively. An outer shroud comprising walls 24, 26 and roof 28 may be disposed about furnace construction 10. It is to be understood that FIG. 1 is illustrative of only a cross section of a furnace. Elongate metal rods 30 tie shroud walls 24, 26 into associated refractory wall panels. Rods 30 are constructed to have a degree of flexibility to permit the refractory wall panels to move or shift slightly to compensate for temperature variations within furnace area 15.

Figure 2:
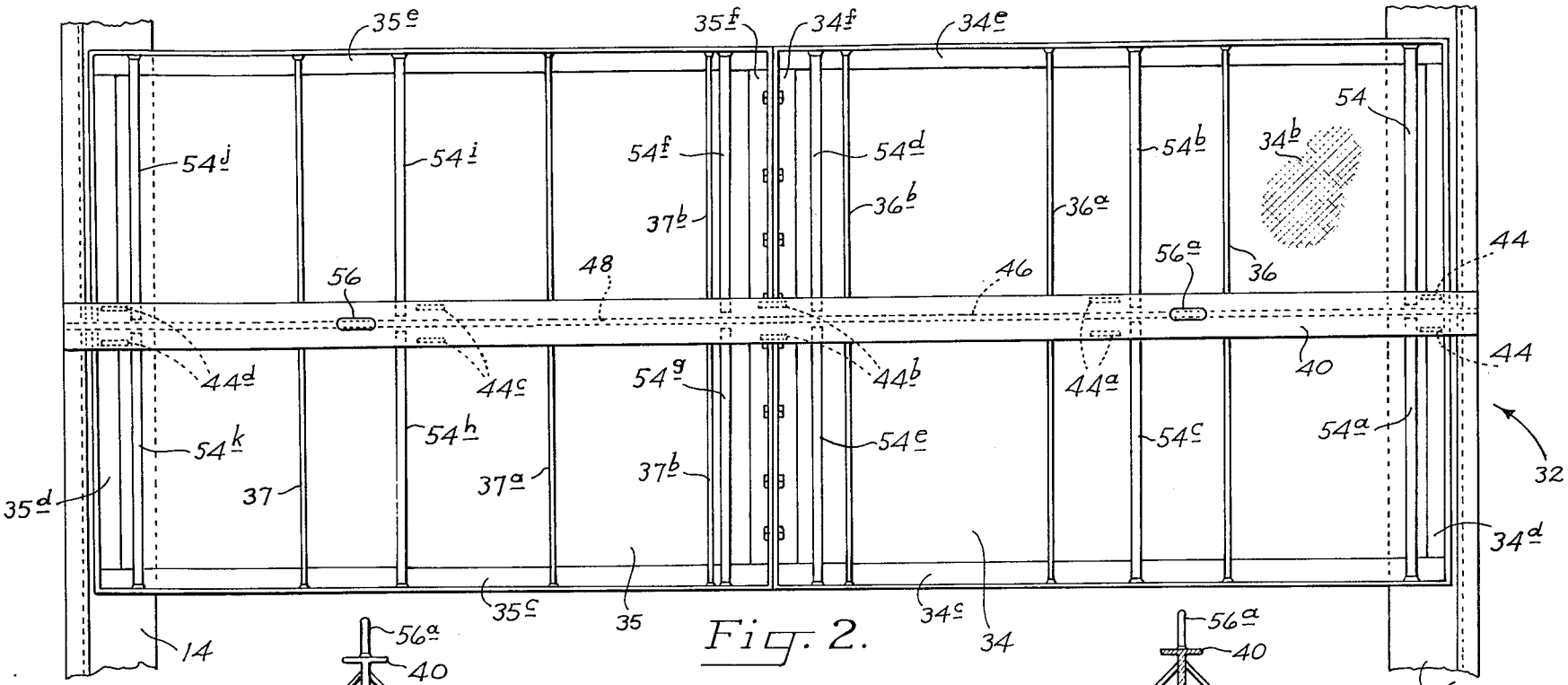
FIG. 2 is a top view of a truss supporting two refractory roof panel sections.

According to the principles of the present invention, a truss-panel roof assemblage generally indicated at 32, is disposed on top of refractory wall panels 14, 16. Considering both FIGS. 1 and 2, details of the truss-panel roof assemblage 32 can be more readily appreciated. Roof assemblage 32 utilizes including a pair of joined roof panel sections 34, 35, each of which is constructed similarly to wall panels 12, 14, etc. Roof panel 34 has a cementitious refractory material 34*a* defining a thickness which is poured over expanded mesh material 34*b*. Frame members 34*c*, 34*d*, 34*e*, and 34*f* are constructed of angle iron and form a peripheral rectangular base frame to which mesh 34*b* is attached, mesh 34*b* having anchors (not shown) which serve to secure hardened cementitious refractory material 34*a* to the frame members. Transversely disposed and secured to frame members 34*c*, 34*e* are a plurality of suspension bars 36, 36*a*, and 36*b*. Likewise, roof panel 35 is provided with frame members 35*c*, 35*d*, 35*e* and 35*f*. Suspension bars 37, 37*a* and 37*b* are also provided on roof panel 35. The function and purpose of suspension bars 36, 37, etc. will be more particularly described hereinafter. Frame members 34*f*, 35*f* are bolted or otherwise joined together to provide joined panels sufficient to span the distance between the walls. While two roof panels have been shown, other combinations may be practical.

Figure 4:
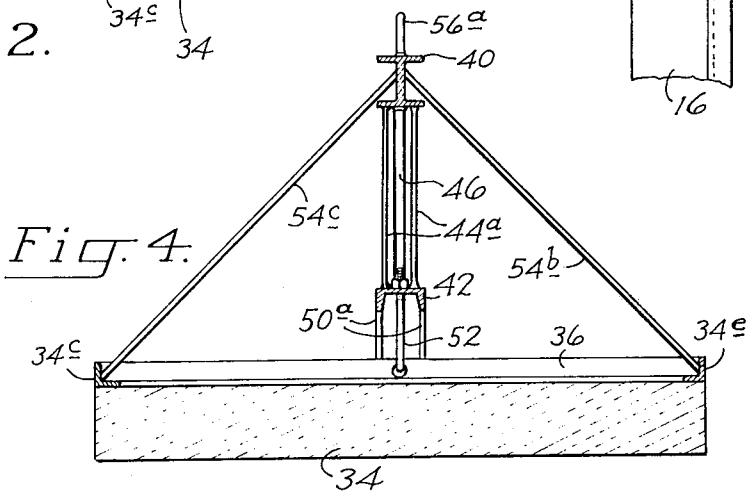
FIG. 4 is a view taken along lines 4—4 of FIG. 1.
Figure 3:
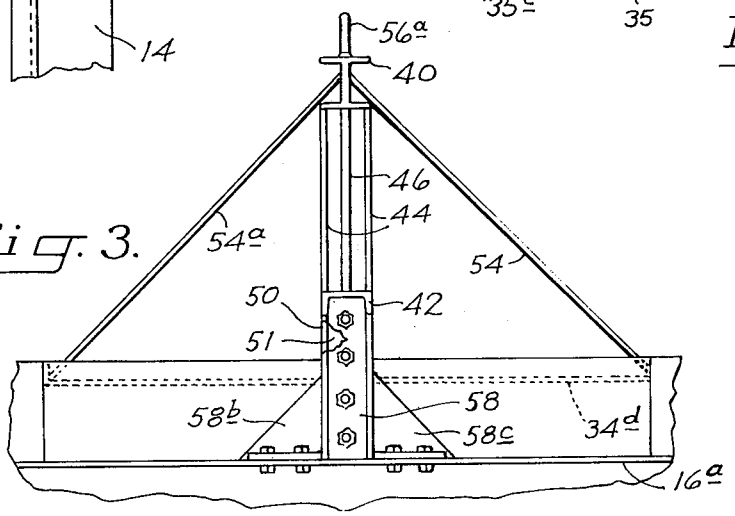
FIG. 3 is a view taken along lines 3—3 of FIG. 1.

A roof truss, generally designated at 38 includes an I-beam top chord 40 and an inverted channel member bottom chord 42. Top chord 40 and bottom chord 42 are connected together by means of uprights 44, 44*a*, 44*b*, 44*c*, and 44*d*. Also, diagonal tension web members 46, 48 are provided to increase the load bearing capability of truss 38. As can be seen from a consideration of FIGS. 2–4, truss 38 is disposed substantially intermediate the width of connected roof panels 34, 35.

The present invention contemplates that roof assemblage 32 will consist of truss 38 attached to panels 34, 35 to form a unit which may be readily lifted onto or from the top of refractory wall panels. To this end, in one embodiment, roof panels 34, 35 are contemplated as being constructed in a hung ceiling organization from truss 38. Truss 38 is connected to transverse frame members 34*d* and 35*d* by means of spacer uprights 50, 50*a*, respectively. Depending from bottom chord 42 are a plurality of attached J-hook hangers 52, 52*a* and 52*b*, which are hooked through holes or otherwise secured to transversely extending suspension bars 36, 36*a*, 36*b*, respectively. Similarly, hanger 52*c* is attached to suspension bar 37. The hangers connected to suspension bars 37*a* and 37*b* are not shown as truss 38 has been shortened to conserve space in FIG. 1. The number of suspension bars and hangers are determined by a particular truss-panel configuration and loading. Hangers 52, 52*a*, etc. serve to support roof panels 34, 35 when truss panel roof assemblage 32 is disposed as a unit on top of refractory wall panels.

Further, it is to be noted that roof assemblage 32 utilizes a plurality of struts 54, 54*a*–54*k*, etc. which further strengthen and add lateral support to truss 38 attached to panels 34 and 35. In FIG. 1, struts 54*a*, 54*c*, 54*e*, 54*g*, 54*h* and 54*k* have not been shown for the sake of clarity in illustrating other structure.

It is contemplated that roof assemblage 32 will be constructed as a unit and lifted into place on top of wall panels 14 and 16. Accordingly, lifting eyes 56, 56*a* are provided on top of top chord 40 to permit attachment of lifting cables 57, 57*a* which depend from a lifting device (not shown).

In one embodiment, it is contemplated that truss panels 34, 35 will be suspended lengthwise over their entire length when roof assemblage 32 is attached in place on top of wall panels 14, 16. To this end, bearing anchors 58 and 58*a* are provided which will transmit load forces from truss 38 onto wall panels 14 and 16 downwardly through lower wall panels 12, 18 to floor 11. As can be seen from a consideration of FIG. 3, bearing anchor 58 is seated underneath bottom chord 42 and may be bolted or otherwise connected to a plate 51 which is secured to spacer uprights 50. Bearing anchor 58*a* also is connected by means of bolts onto a transverse frame member 16*a* of wall panel 16. Bearing anchor 58 may be appropriately formed with flanges 58*b* and 58*c* for increased lateral support. Likewise, bearing anchor 58*a* is attached to the opposite end of bottom chord 42 and transversely extending frame member 14*d* of panel 14. Insulative pads 60, 61, are disposed between wall panels 14, 16 and roof panels 35, 34, respectively. Thus, it can be seen that loads imparted to truss 38 from panels 34, 35 during static loading or during extra loading caused by distortion due to heating, etc. will be transmitted through bearing anchors 58, 58*a* ultimately to floor 11. A hung roof construction is thereby provided for furnace construction 10.

In a second embodiment, it is contemplated that roof panels 34, 35 will, at least partially, directly bear on wall panels 16, 14, respectively. Thus, an end portion of panels 34, 35 will be supported upon respective wall panels and only an intermediate portion of roof panels 34, 35 will be suspended between wall panels 14, 16. A portion of the load on roof truss 38 will be transmitted through anchors 58, 58*a* and also through wall bearing end portions of panels 34, 35. In such a construction, a smaller span of wall panels 34, 35 will actually be suspended beneath bottom chord 42. Accordingly, it is contemplated that bearing anchor 58, 58*a* will be somewhat shorter than bearing anchors used when a true hung roof structure is employed.

An additional feature of the present invention resides in the use of elongate rods or pipes 62, 62*a,* 62*b,* etc. which are received within lugs 63, 63*a,* etc. respectively in order to prevent substantial misalignment of adjacent connected wall panels due to flexure caused by internal heating or roof loading. It is contemplated that lugs 63, 63*a,* etc. will be provided as required on upright wall panels so that elongate rods 62, 62*a,* etc. will substantially span their lengths to prevent misalignment between adjacent panels.

While the invention has been particularly shown and described with reference to the foregoing preferred embodiments thereof, it will be understood by those skilled in the art that other changes in form and detail may be made therein without departing from the spirit and scope of the invention as defined in the appended claims.

What is claimed is:

1. A furnace having upright, laterally spaced refractory wall panels and a truss-panel roof assemblage comprising:

at least one refractory roof panel having supporting frame members attached to an upper face thereof, said roof panel dimensioned lengthwise to span the distance between said wall panels;

a load supporting truss having top and bottom chords, said truss disposed above said roof panel and rigidly connected to said frame members by means of upright legs, said legs interconnecting said bottom chord adjacent opposite ends thereof to said frame members to maintain a selected spacing between said bottom chord and said upper face;

removable means comprising a bearing anchor provided at opposite ends of said truss for releasably connecting said bottom chord to said wall panels for enabling truss loads to be transmitted to said wall panels, said bearing anchors also providing lateral support to said truss-panel roof assemblage; and a plurality of bracing struts interconnecting said top chord and said frame members for providing additional lateral support to said truss.

2. A furnace as described in claim 1 wherein upright legs interconnect said bottom chord and said roof panel to maintain a selected spacing between said bottom chord and said upper face.

3. A furnace as described in claim 1, wherein a plurality of suspension bars are secured to and extend transversely of said upper face, and wherein a plurality of elongate hangers are connected adjacent one set of their ends to said bottom chord at locations spaced along the length of the bottom chord, and are connected adjacent their other set of ends to said suspension bars for suspending said roof panel along its length below said bottom chord.

4. A furnace as described in claim 1, wherein at least one lifting hook or the like is provided on said truss to enable a truss-panel assemblage to be lifted from or set onto upright refractory wall panels.

5. A furnace having upright, laterally spaced refractory wall panels and a truss-panel roof assemblage comprising:

at least one refractory roof panel having supporting frame members attached to an upper face thereof and a plurality of suspension bars secured to and extending transversely of said upper face, said roof panel dimensioned lengthwise to span the distance between said wall panels;

a load supporting truss having top and bottom chords, said truss disposed above and intermediate the width of said roof panel, upright legs interposed between said bottom chord and said roof panel to connect said bottom chord to said frame members and maintain a selected spacing between said bottom chord and said roof panel upper face;

removable bearing anchors, one each of said anchors being provided at both ends of said truss for releasably connecting said bottom chord to an associated one of said upright wall panels for enabling said truss to bear down onto and transmit loads to said wall panels;

a plurality of elongate hangers connected adjacent one set of their ends to said bottom chord at locations spaced along the length of said bottom chord, and connected adjacent their other set of ends to said suspension bars for suspending said roof panel below said bottom chord; and at least one lifting hook or the like provided on said truss to enable a truss-panel assemblage to be lifted from or set onto upright refractory wall panels.

* * * * *